United States Patent [19]

Trauschke

[11] Patent Number: 4,932,519

[45] Date of Patent: Jun. 12, 1990

[54] SHADOW BOX HEADLIGHT CARTON AND BLANK

[75] Inventor: William F. Trauschke, Topsfield, Mass.

[73] Assignee: GTE Products Corporation, Danvers, Mass.

[21] Appl. No.: 252,408

[22] Filed: Oct. 3, 1988

[51] Int. Cl.[5] ..... B65D 85/42

[52] U.S. Cl. ..... 206/45.31; 206/45.14; 206/418; 229/162

[58] Field of Search ..... 206/418, 419, 420, 422, 206/45.14, 45.19, 45.31, 45.34, 45.33; 229/162

[56] References Cited

U.S. PATENT DOCUMENTS

| | | | |
|---|---|---|---|
| 2,128,197 | 8/1938 | Weil | 206/45.31 |
| 2,621,787 | 12/1952 | Harris | 229/162 X |
| 3,592,338 | 7/1971 | Hanson | 206/45.19 |
| 3,638,848 | 2/1972 | Heyworth | 229/162 X |
| 3,664,493 | 5/1972 | Dutcher | 206/45.31 X |
| 3,835,989 | 9/1974 | Mori et al. | 206/45.31 |
| 3,878,941 | 4/1975 | Kelner | 206/419 |
| 4,018,335 | 4/1977 | Jacob et al. | 206/472 |
| 4,162,008 | 7/1979 | McCalmont | 206/45.14 X |
| 4,345,687 | 8/1982 | Davidson | 206/418 |

FOREIGN PATENT DOCUMENTS

| | | | |
|---|---|---|---|
| 1484046 | 5/1967 | France | 206/45.31 |
| 1280819 | 7/1972 | United Kingdom | 206/418 |

*Primary Examiner*—Bryon P. Gehman
*Attorney, Agent, or Firm*—William E. Meyer

[57] ABSTRACT

A shadow box carton having smooth continuous connections extending from a window display, and cleanly hinged front facing shadow box edges is described. The shadow box carton includes specially hinged front facing corners that result in a better looking carton that is also stronger and more durable.

24 Claims, 4 Drawing Sheets

SHADOW BOX HEADLIGHT CARTON AND BLANK

TECHNICAL FIELD

The invention relates to packaging and particularly to folded boxes. More particularly the invention is concerned with an improved shadow box type carton.

BACKGROUND ART

A shadow box is a display carton with a rectangular frame that a viewer may look into to see a displayed product. For most products, a carton encloses the whole product, shielding the product from damage, but also hiding the product from view. To inform customers as to the nature of the actual product a widow may be formed in the carton. A clear window covering may offer insufficient protection for the exposed product, as for example, where glass product is displayed, and contact between adjacent packages may cause one glass item to strike a second glass item resulting in fracture of the product. The shadow box over comes these deficiencies by providing a surrounding frame that projects from the window area. Unlike a picture frame, where a rectangular frame extends in a plane around the picture, the frame of a shadow box projects perpendicular to the front plane of the displayed product. The projecting frame then acts as a standoff, warding off objects that might impact the window area, and injuring the displayed object.

Shadow box cartons are known in the art, and in particular are known to be used in packing automobile headlamps. An example may be seen in U.S. Pat. 4,345,687 issued to Thomas L. Davidson for a Collapsible Headlight Carton and Blank for Making the Same. The known method of forming a shadow box carton for automobile headlamps is to fold a tube structure coaxial with the lamp axis. A flap extending from the front end of the tube includes a window and frame structure which is folded over and into the end of the tube structure. Flaps from the remaining tube walls are then folded over and into the tube end to position and support the window and frame structure. In effect, the end of the tube conveniently forms the extended rim of the shadow box. The flaps may be glued to the frame edge or captured by tabs. The opposite end of the tube is sealed by folding flaps over the exposed rear of the head light. To keep the headlamp from shifting, a strap, or similar pinning structure may be built across the inner surfaces of the tube to restrict headlamp motion. A window may also be build in the rear covering flaps, so a consumer may view the connectors on the back of the headlamp.

The existing design for a shadow box carton is not fully satisfactory. The folded flaps around the window panel rarely seal cleanly with the window frame. The edges and joints framing the product display window are open, and even though sealed may have an irregular or messy look. There then exists a need for a shadow box carton having a viewing face uncluttered by flaps, and flap edges.

More importantly, the existing design is mechanically weak. The current designs form the display window, or windows in the weak section of a carton, the closure. The tube structure covered with windows at each end, is inherently weak. The tube naturally collapses across the tube axis, where the weaker window panel is positioned. The contained mass naturally slides along the tube axis to be stopped by the tube end, the weaker window panel. The weaker window panel is also only sealed around three sides and not continuous with adjacent tube walls. The mass of an automobile headlight in combination with normal shipping and customer examination motions can generate sufficient force to break down the seals around a window panel. Furthermore, the leading edge of the shadow box is expected to sustain blows in the usual course of packing, shipping and display. In the known designs, the leading edge of the shadow box is adjacent the carton seal, and the associated seal seams, and flaps. Blows to the leading edge distort the adjacent flaps and seals, and the seal tends to pop open. The breakdown of the carton seal can then result in the headlight falling free. There is then a need for a shadow box carton wherein the shadow frame securely holds the enclosed product, and blows to the leading edge do not tend to open the carton.

DISCLOSURE OF THE INVENTION

A shadow box carton generally in the form of a parallelepiped with three orthogonal dimensions may be formed with a rectangular window panel having a front side and a back side, including a window portion formed within the perimeter of the window panel; four rectangular shadow frame panels, each shadow frame panel having a mutually shared joint coextensive with a respective edge of the window panel, each shadow frame panel being forward of the front side of the window panel and perpendicular to the window panel; four side panels, each having a mutual shared joint coextensive with a respective shadow frame panel joint, parallel with and opposite the mutual joint shared with the window panel, each of the side panels being adjacent and parallel with each respective shadow frame panel and extending rearward of the front side of the window panel, thereby creating a shadow frame overhang around the window panel. A back panel positioned rearward of the front side of the window panel, and offset from the window panel, and means for coupling the side panels and back panel may be used to close the carton. The structure then provides a shadow frame carton with a face that is free of flaps and seals. The result is then clean looking and mechanically strong. The carton is further improved by including at least one flap hinged from a first side panel at 90° and then pinched between an adjacent shadow frame panel and respective side panel. The pinched flap squares up the adjacent pinching shadow frame panel, and anchors the corners from rotation.

BEST MODE FOR CARRYING OUT THE INVENTION

Figure 1:
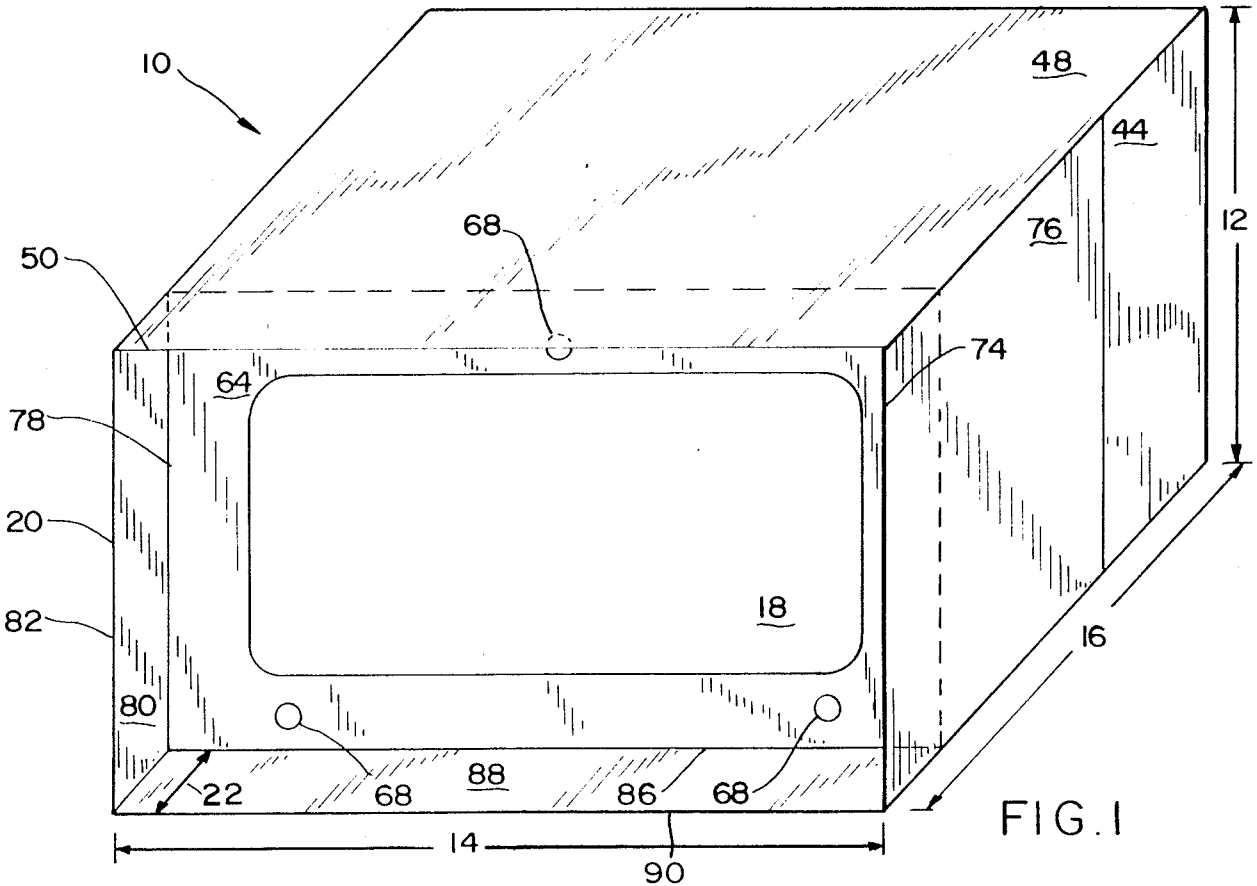
FIG. 1 shows front perspective view of a preferred embodiment of a shadow box carton.

FIG. 1 shows a preferred embodiment of a shadow box carton 10. The shadow box carton 10 has the overall form of a right rectangular parallelepiped having a height 12, a width 14 and a depth 16. A window 18 is formed in the face providing a view of the carton contents Hinged at right angles to the four edges of the window panel are four shadow frame panels. Each shadow frame panel is in turn hinged at 180° respectively to adjacent top, side or bottom panels thereby forming a shadow frame around the window panel. While top side and bottom side may be formally distinguished from right side and left side, a simple clockwise rotation of a parrallelipiped causes the top side to be become the right side, the right side to become the bottom side and so n. Side panel is therefore used to generally represent a planar face that is not the front or back. Perpendicular to the plane of the window 18, and enclosing the shadow frame area is an extended rim with a leading edge 20 The window 18 panel is then offset from the leading edge 20 by a shadow frame depth 22 The rim with leading edge 20 acts as a frame for the displayed contents, and as a guard to ward of impacts to the displayed contents.

Figure 2:
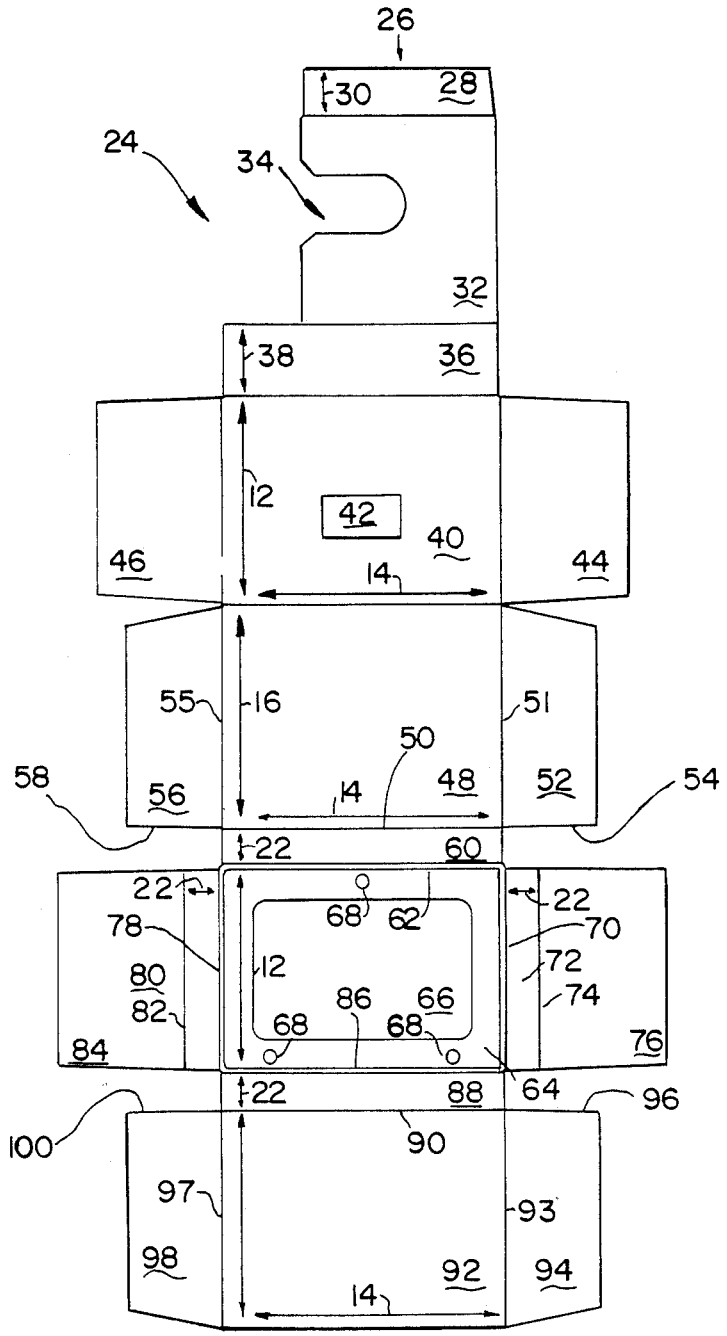
FIG. 2 shows an unfolded preferred blank for the shadow box carton of FIG. 1.

FIG. 2 shows a preferred blank 24 for the shadow box carton 10 of FIG. 1. The blank 24 comprises a single flat cardboard piece cut in outline, and scored with fold lines All of the panels and included elements of the shadow box carton 10 are encompassed in the single piece by the outlined form. The panels are for the most part rectangular, with fold lines arranged in a perpendicular grid pattern. In the preferred embodiment, the blank 24 comprises a main row 26 of rectangular panels, parallel, adjacent and hinged to each other along score lines. Each hinged linkage between adjacent panels on the main row 26 is along a mutually shared fold line that is coextensive and complete between the adjacent panels. Adjacent and extending at right angles to the main row 26 panels, are flaps and covers, also linked to the main row 26 panels along hinging fold lines. The flaps and covers are therefore also coextensive and solidly linked each along a mutually shared edge of one and only one of the adjacent main row panels. While the flaps and covers in the unfolded blank 24 may have further adjacent side sections, none of the flaps and covers of the embodiment shown in FIG. 2 are joined to one another.

First in the series of panels on the main row 26 is a first leg panel 28. The first leg 28 panel has no more than the carton width 14 and a first leg height 30 less than the carton depth 16. The first leg height 30 helps position the carton contents with respect to the window 18.

Joined next along the main row 26, and hinged to the first leg panel 28 is a platform panel 32 to span between the carton walls and support the carton contents. The preferred platform 32 has the carton height 12 and somewhat less than the carton width 14. The platform panel 32 has a cut out mating portion 34 to conform with an exterior surface of the carton contents. The preferred embodiment of the cut out mating portion 34 extends into the left side edge of the platform panel 32 and is designed to receive, and position the curved back of a headlight reflector. The platform 32 may be reinforced with a second layer of material such as described in U.S. Pat. 4,345,687.

Joined next along the main row 26, and hinged to the platform panel 32 is a second leg panel 36 with the carton width 14 and a second leg height 38. In the preferred embodiment, the first leg height 30 is less than the second leg height 38 to allow adjustment of the platform 32.

Joined next along the main row 26, and hinged to the second leg panel 36 is a back panel 40 with the carton height 12 and width 14. Formed within the perimeter of the back panel 40 may be a back window 42 to expose the rear of the carton contents. Hinged perpendicular to the main row 26 at either side of the back panel 40 are a right back cover panel 44, and a left back cover panel 46. The back cover panels 44, 46 may have the carton height 12 and no more than the carton depth 16. The back cover panels 44, 46 may also have angled edges leading away from the main row 26 to facilitate closure.

Joined next along the main row 26, and hinged to the back panel 40 is a top panel 48 with the carton width 14 and depth 16. The top panel 48 includes, perpendicular to the main row 26, opposite the hinge between the back panel 40 and top panel 48, a front facing top rim hinge 50. Perpendicular to the main row 26 along the right side of the top panel 48 hinged at top right flap hinge 51 is a top right dust flap 52. Perpendicular to the top right flap hinge 51 and on a front end of the top right dust flap 52 is a top right support edge 54. Preferably the top right support edge 54 is slightly offset from being colinear with the top rim hinge 50 by about the thickness of the blank 24 to allow square final positioning of the top right dust flap 52.

In a similar fashion, perpendicular to the main row 26 along the left side of the top panel 48 hinged at top left flap hinge 55 is a top left dust flap 56 having the carton depth 16 and no more than the carton height 12. Perpendicular to the top left flap hinge 55 and on a front end of the top left dust flap 56 is a top left support edge 58. Preferably the top left support edge 58 is also slightly offset from being colinear the top rim hinge 50 by about the thickness of the blank 24 to allow square final positioning of the top left dust flap 56. The remaining edges of the top dust flaps 52, 56 may be angled to facilitate closure.

Joined next along the main row 26, and hinged to the top panel 48, along the top rim hinge 50 is an upper shadow frame panel 60 with the carton width 14 and the shadow frame depth 22. Parallel with and opposite the top rim hinge 50 is an upper window hinge 62.

Joined next along the main row 26, and hinged to the upper shadow frame panel 60 along the upper window hinge 62 is a window panel 64 with the carton height 12 and width 14. Formed within the perimeter of the window panel 64 is a front window 66 to display the carton contents. The window panel 64 in the preferred embodiment also includes three cut out mating portions 68 to capture three guide nipples extending from a headlight face.

Hinged perpendicular to the main row 26 on the right side of the window panel 64 along a right window hinge 70 is a right shadow frame panel 72 having the carton height 12 and the shadow frame depth 22. Parallel with and opposite the right window hinge 70 is a right rim hinge 74. Hinged to the right shadow frame panel 72, along the right rim hinge 74 is a right a right side cover panel 76 having the carton height 12 and no more than the carton depth 16.

Similarly, hinged perpendicular to the main row 26 on the left side of the window panel 64 along a left window hinge 78 is a left shadow frame panel 80 having the carton height 12 and the shadow frame depth 22. Parallel with and opposite the left window hinge 78 is a left rim hinge 82. Hinged from the left shadow frame panel 80, along the left rim hinge 82 is a left side cover panel 84 having the carton height 12 and no more than the carton depth 16.

Joined next along the main row 26, and hinged to the window panel 64 along a lower window hinge 86 is a lower shadow frame panel 88 with the carton width 14 and shadow frame depth 22. Parallel with and opposite the lower window hinge 86 is a bottom rim hinge 90. In the preferred embodiment, the window hinges between the window panel 64 and the shadow frame panels 60, 72, 80, 88 are formed with reverse side scores.

Joined next along the main row 26, and hinged to the lower shadow frame panel 88 along the bottom rim hinge 90 is a bottom panel 92 with the carton width 14 and no more than the depth 16. In the preferred embodiment, in combination the depths of the second leg 36 and the bottom panel 92 when coupled provide sufficient length to span the carton depth 16. Perpendicular to the main row 26 on the right side of the bottom panel 92 hinged at bottom right flap hinge 93 is a bottom right dust flap 94 having the no more than the carton depth 16 and no more than the carton height 12. Perpendicular to the bottom right flap hinge 93 and on a front end of the bottom right dust flap 92 is a bottom right support edge 96. Preferably the bottom right support edge 96 is slightly offset from the bottom rim hinge 90 by about the thickness of the blank 24 to allow square final positioning of the bottom right dust flap 94.

Similarly, perpendicular to the main row 26 on the left side of the bottom panel 92 hinged at bottom left flap hinge 97 is a bottom left dust flap 98 having the no more than the carton depth 16 and no more than the carton height 12. Perpendicular to the bottom left flap hinge 97 and on a front end of the bottom left dust flap 98 is a bottom left support edge 100. Preferably the bottom left support edge 98 is slightly offset from the bottom rim hinge 90 by about the thickness of the blank 24 to allow square final positioning of the bottom left dust flap 98. The bottom left dust flap 98 includes a similar bottom left support edge 100. The remaining edges of the bottom dust flaps 94, 98 may have angled edges to facilitate closure.

The shadow box may be assembled by folding the first leg panel 28 90° to the adjacent platform panel 32. The platform panel 32 is in turn folded 90° to the second leg panel 36. The second leg panel 36 is then folded 90° to the back panel 40. The back panel 40 is in turn folded 90° to the top panel 48. The first leg panel 28 is now parallel and adjacent the top panel 48. The first leg panel 28 and top panel 48 are coupled, by for example gluing, to form a solid linkage between the two. In essence a table like portion is formed by the two leg portions supporting the platform section in relation to the back section. Since the table provides internal strengthening, and allows machine loading of headlights, the platform structure is a preferred aspect of the carton actually made. The platform structure is not felt to be necessary to the carton design, and in particular to the folded corner structure of the shadow frame panels. The leg and platform structure may be replaced by other internal positioning structures as are known in the art.

The top panel 48 is then folded 180° to the upper shadow frame panel 60. The top panel 48 and the upper shadow frame panel 60 are then parallel and adjacent forming a closed hinge with the back of the top rim hinge 50 facing forward as a portion of the leading edge 20. The leading edge 20 is then clean looking, free of flaps, and able to withstand blows without opening up. The parallel and adjacent top panel 48 and upper shadow frame panel 60 are in turn folded 90° away from window panel 64. The upper window hinge 62 joint between the upper shadow frame panel 60 and window panel 64 is then continuous and free of flaps.

The lower shadow frame panel 88 is folded 90° away from the window panel 64. The lower window hinge 86 between the window panel 64 and lower shadow frame panel 88 is then continuous and free of flaps. The bottom panel 92 is folded 180° along the bottom rim hinge 90 to be parallel with and adjacent to the lower shadow frame panel 88 forming a closed hinge again with the back of the bottom rim hinge 90 facing forward as a portion of the leading edge 20. The leading edge 20 is then clean looking, and free of flaps.

The second leg panel 36 is then parallel and adjacent with the bottom panel 92, with the second leg panel 36 being enclosed by the bottom panel 92. The second leg panel 36 and bottom panel 92 may then be joined, by for example gluing to form a solid linkage between the two. At this point, the partially assembled shadow box has the form of a rectangular tube with an axis parallel to the window panel 64. The platform panel 32 is the only cross member and is parallel to the tube axis. As a result, the tube may be collapsed in a direction parallel with the main row 26, and perpendicular with the tube axis to form a flattened tube for shipping or storage before final use.

If the carton is in the collapsed form, the flattened tube is squared up before final assembly. The right shadow frame panel 72 is then folded away from the back panel 40 to be 90° to the window panel 64. The top right dust flap 52 and the bottom right dust flap 94 are folded towards each other to be 90° to the respective main row 26 panels. The two right dust flaps 52, 94 are then parallel and adjacent each other, and parallel and adjacent the right shadow frame panel 72. It is useful that the top right support edge 54 and the bottom right support edge 96 be adjacent and coextensive with the right rim hinge 74 to enhance the support of the right shadow frame panel 72. The top right hinge 51 then crosses the corner gap between the upper shadow frame panel 60 and the right shadow frame panel 72, and the gap between the right shadow frame panel 72, and the lower shadow frame panel 88 is crossed by the bottom right flap hinge 93. The right back cover 42 is then folded 90° to the back panel 40 to be parallel and adjacent the right dust flaps 52, 94. The right side cover panel 76 is folded 180° to the right shadow frame panel 72, away from the window panel 64 and over the right dust flaps 52, 94. The right shadow frame panel 72 and right side cover panel 76 now enclose and pinch the right dust flaps 52, 94, and the right back cover panel 44 if the right back cover panel 44 extends as far as the right shadow frame panel 72. Simultaneously, the right dust flaps 52, 94 support and position the right shadow frame panel 72 and the right side cover panel 76. Since the right dust flaps 52, 94 are coupled at right angles to the top panel 48 and bottom panel 92, the right dust flaps 52, 94 are prohibited from motions other than rotation from the top panel 48 and bottom panel 92. The right dust flaps 52, 94 then mechanically restrict and mechanically support the right shadow frame panel 72 and right side cover panel 76 along the respective right support edges 54, 96. The right back cover panel 44 and right side cover panel 76 may then be joined by for example, gluing to form a solid linkage between the two right back cover panel 44 and right side cover panel 76 to complete the closure of the right side. Alternatively, the right side cover panel 76 may be folded over the exterior of the right shadow frame panel 72 however, the resulting structure is felt to be somewhat less strong. A portion of the leading edge 20 is then cleanly formed by the back of the hinge made by the right side shadow frame panel 64, and the right side cover panel 76, pinning and being supported by the right side dust flaps 52, 94. The window panel 64 has a clean and folded joint with the right shadow frame panel 72 that is flap free.

The partially assembled shadow box now has a remaining left side open. The carton contents, for example, a headlight, may be inserted in the left side opening defined by the left flaps and cover panels, to be positioned on the platform panel 32. The front the the headlight may be exposed through or captured in the front window 66. Headlights commonly have guide nipples formed on the lens face to assist alignment. The headlight may then be further positioned by capturing the guide nipples in the cut out mating portions 68. The rear of the headlight showing the headlight connectors may be exposed for viewing through the back window 42.

For final assembly, the left shadow frame panel 80 is folded away from the back panel 40 to be 90° to the window panel 64. The top left dust flap 56 and the bottom left dust flap 98 are folded towards each other to be 90° to the respective main row 26 panels. The two left dust flaps 56, 98 are then parallel and adjacent each other, and parallel and adjacent the left shadow frame panel 80. It is useful that the top left support edge 58 and the bottom left support edge 100 be adjacent and coextensive with the left rim hinge 82 to enhance the support of the left shadow frame panel 80. The top left hinge 55 then crosses the corner gap between the upper shadow frame panel 60 and the left shadow frame panel 80, and the gap between the left shadow frame panel 80, and the lower shadow frame panel 88 is crossed by the bottom left flap hinge 97. The left back panel cover panel 46 is then folded 90° to the back panel 40 to be parallel and adjacent the left dust flaps 56, 98. The left side cover panel 84 is folded 180° to the left shadow frame panel 80, away from the window panel 64 and over the left dust flaps 56, 98. The left shadow frame panel 80 and left side cover panel 84 now hinge over to enclose and pinch the left dust flaps 56, 98. Simultaneously, the left dust flaps 56, 98 support and position the left shadow frame panel 80 and the left side cover panel 84 along the respective left support edges 58, 100. Since the left dust flaps 56, 98 are coupled at right angles to the top and bottom, the dust flaps 56, 98 are prohibited from motions other than rotation from the main row 26 panels. The left dust flaps 56, 98 then mechanically restrict and mechanically support the left shadow frame panel 80 and left side cover panel 84. The left back cover panel 46, and the left side cover panel 84 may then be joined, by for example, gluing to form a solid linkage between the two covers. A portion of the leading edge 20 is then cleanly formed by the back of the hinge made by the left side shadow frame panel 80, and the left side cover panel 84, pinning and being supported by the left side dust flaps 56, 98. The window panel 64 has a clean and folded joint with the left shadow frame panel 80 that is flap free. Since the window panel 64 is linked continuously through more than one shadow frame panel to the sturdy top panel 48, bottom panel 92 and side cover panels 76, 84, that is the major walls of the carton, the front portion of the carton has enhanced ability to withstand blows without opening up.

Figure 3:
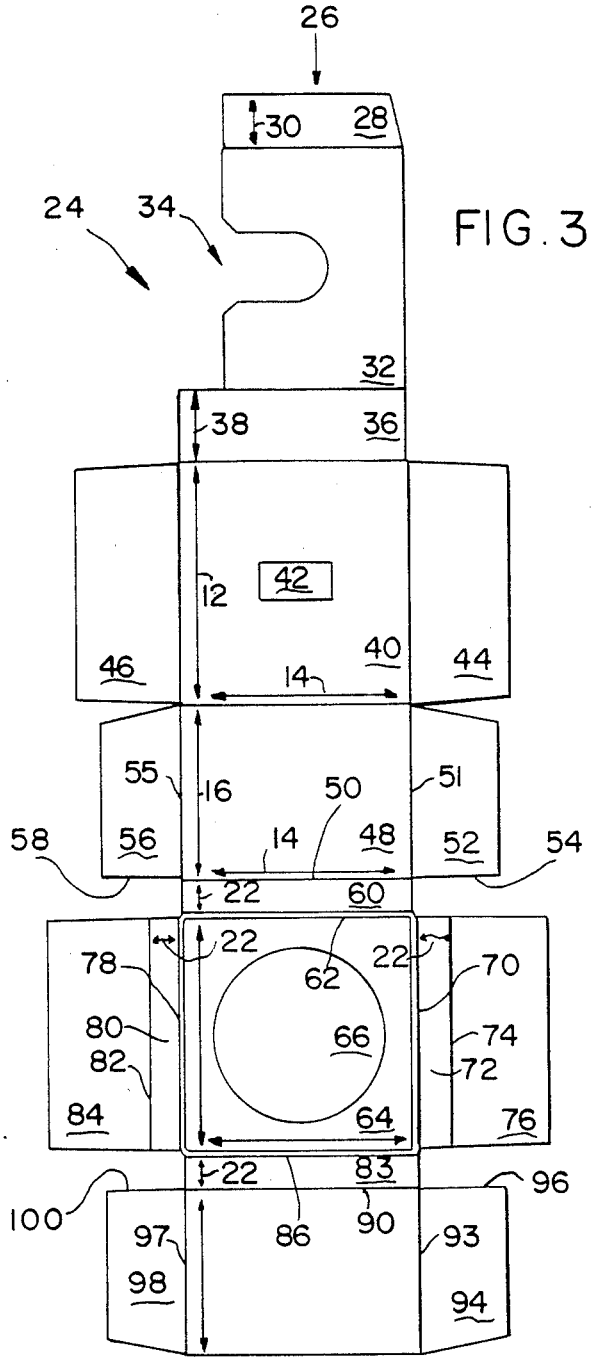
FIG. 3 shows an unfolded alternative preferred embodiment blank for a shadow box carton.

FIG. 3 shows an alternative preferred embodiment of unfolded blank with the height and width of the carton being equal, thereby giving a square front shadow frame. The back panel 40 and the window panel 64 are therefore square. The window panel 64 as a variation includes a circular window 66 for displaying a circular item, such as a circular auto headlight. The cut out mating portions 68 have been eliminated.

Figure 4:
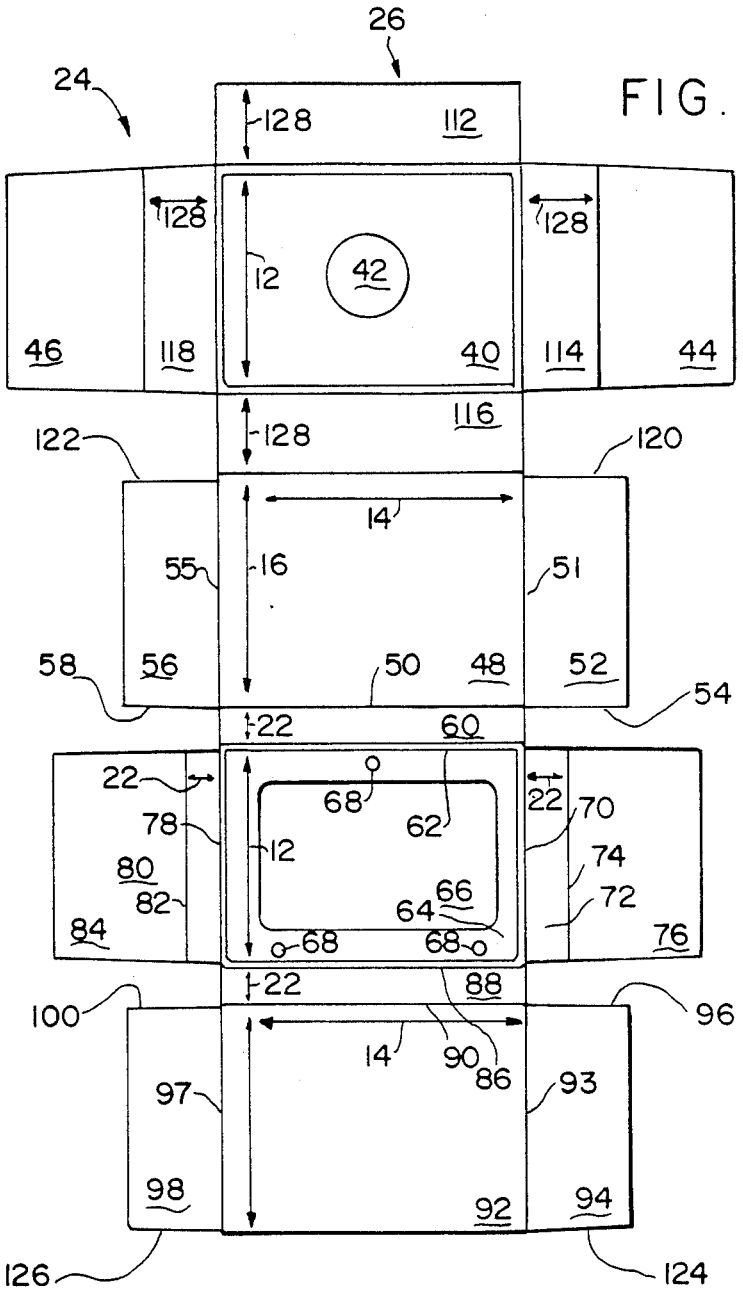
FIG. 4 shows an alternative preferred embodiment of an unfolded blank 24 for a shadow frame carton with both front and back shadow frame structures.

FIG. 4 shows an alternative preferred embodiment of an unfolded blank 24 for a shadow frame carton with both front and back shadow frame structures. The back panel 40 and rear window 42 of the structure shown in FIG. 1 may be replace with a rear shadow frame structure similar to the front shadow frame structure shown. Four shadow frame panels 112, 114, 116, 118 are positioned around the back panel 40, and support edges 120, 122, 124, 126 are formed respectively on the back sides of the top and bottom dust flaps 52, 56, 94, 98. The bottom panel 92 extending from the front lower shadow frame panel to and overlap the lower back shadow frame panel 112. The bottom panel 92 and the lower back shadow frame panel 112 may be coupled by gluing or other known means. The bottom panel 92 is then not hinged to lower back shadow panel 112. A hinge structure may be included by adding an extending tab to the lower back shadow frame panel 112. The front side shadow frame depth 22 need not be equal to the rear shadow frame depth 128. For a headlight carton, the rear shadow frame depth 128 may for example be equal to or greater than any protruding plug connections. The function of the supporting leg and platform structure may be replaced by cut outs formed in the back window panel serving supports or guides for the carton contents. The preferred embodiment uses the rear window 42 as both a window and positioner.

In a first working example, a carton with a rectangular face and rectangular window was designed to contain a rectangular auto headlight with three guide nipples. Some of the dimensions were approximately as follows: The window panel was 13.6 cm by 19.5 cm with a 9.4 cm by 15.4 cm rectangular window and three 0.8 cm circular guide nipple holes. The top and bottom panels were 14.5 cm by 19.5 cm. The back was 13.7 cm by 19.5 cm with a 5.4 cm by 2.8 cm back window. The shadow-frame panels were 2.4 cm by 19.5 cm. The dust flaps were 6.7 cm by 14.5 cm tapered to 13.5 cm. The cover panels were 8.7 cm by 13.5 cm. The first leg panel was 3 cm by 13.8 cm. The second leg panel was 4.5 cm by 19.5 cm. The platform panel was 13.5 cm by 14.0 cm with a 3.8 cm by 7.1 cm circular ended cut out.

In a second working example, a carton with a squared face and round window was designed to contain a circular auto headlight. Some of the dimensions were approximately as follows: The window panel was 14 cm by 14 cm with a 10.8 cm circular window. The top and bottom panels were 14 cm by 10.5 cm. The back was 14 cm by 14 cm with a 5.4 cm by 2.9 cm back window. The shadow frame panels were 2.4 cm by 14 cm. The dust flaps were 6.4 cm by 10.5 cm tapered to 9.0 cm. The covers were 6.5 cm by 14 cm. The first leg panel was 3 cm by 11 cm. The second leg panel was 4.5 cm by 14.0 cm. The platform panel was 14.0 cm by 11.2 cm with a 5.2 cm by 7.0 cm circular ended cut out. In the above working examples, drop tests were blanked and the carton seals did not open, nor did the window panels become ragged with exposed or loose flaps.

The disclosed dimensions, configurations and embodiments are as examples only, and other suitable configurations and relations may be used to implement the invention. It is clear that cartons may be rotated, and otherwise reoriented. The relative names of top, bottom and the like are then altered. The names chosen here are for purposes of explanation and are not related to absolute positions on a carton. In particular, the top and bottom panels are effectively side panels with respect to the window panel. It is also evident that while the preferred embodiment is to use material continuous across fold lines, separately structured panels may be formed that are then linked along shared portions to effectively form the equivalent of material continuous along fold lines. Similarly, while the preferred embodiment uses continuous, coextensive fold lines between linked panels, perforations along fold lines may be used to promote folding sections may be removed from the fold lines to relieve stresses, form decorative patterns, or for other purposes. The support edges of the flaps need not extend for the full length of the hinge between the shadow frame panel and the respective side panel. It is a well known in the folded box art that Panels may be moved from one attachment point to another, thereby yielding a different blank, but still producing the same box when the blank is folded. A tab, or tongue may be required to provide sufficient strength to the new linkages. Variations in the blank pattern are anticipated, and all such blank variations when folded that produce the shadow box carton described are considered equivalent to the described structure. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A shadow frame carton generally in the form of a parallelepiped with three orthogonal dimensions comprising:

(a) a rectangular window panel having a front side and a back side, and including an edge defining a window portion within the perimeter of the window panel, (b) four-sided shadow frame panels, each shadow frame panel having a mutually shared window hinge edge coextensive with a respective edge of the window panel, each shadow frame panel being forward of the front side of the window panel and perpendicular to the window panel, (c) four side panels, corresponding respectively to a top side, right side, bottom side, and left side of the parallelepiped, each having a mutual shared rim hinge edge coextensive with a respective shadow frame panel edge, opposite the respective window hinge edge mutually shared with the window panel, each of the side panels being adjacent and parallel with each respective shadow frame panel and extending rearward of the front side of the window panel, (d) a back panel positioned rearward of the front side of the window panel, and offset from the window panel, and (e) means for coupling the side panels and back panel to close the carton.

2. The shadow frame carton in claim 1, wherein the window hinge and rim hinge edges of the shadow frame panels are parallel.

3. The shadow frame carton in claim 1, wherein the respective side panels are rectangular.

4. The shadow frame carton in claim 1, wherein the four shadow frame panels and four respective side panels are hinged and materially continuous.

5. The shadow frame carton in claim 1, wherein the shadow frame panels having a common measurement in the direction perpendicular to the window panel.

6. The shadow frame carton in claim 1, wherein the means for coupling the back panel to the side panels includes a materially continuous linkage along a mutually shared edge between one of the side panels and the back panel, the shared edge being opposite and offset from the rim edge shared by the side panel and its respective shadow panel.

7. The shadow frame carton in claim 1, wherein the means for coupling the side panels to complete the closure of the carton includes at least one flap hinged to a first side panel on a side adjacent the rim edge shared with the respective first shadow frame panel, the flap being positioned parallel and adjacent a second side panel, to thereby be sealable to the adjacent second side panel.

8. The shadow frame carton in claim 7, wherein at least one flap of a respective first side panel is positioned adjacent and parallel with both the adjacent second side panel and the shadow frame panel of the second side panel.

9. The shadow frame carton in claim 8, wherein the flap positioned adjacent the second side panel and the second shadow frame panel is positioned between the second side panel and the second shadow frame panel.

10. The shadow frame carton in claim 9, wherein the flap positioned between the second side panel and the second shadow frame panel includes a support edge parallel and adjacent with at least a portion of the mutually shared rim edge of the second side panel and the second shadow frame panel.

11. A one piece planar carton blank for producing a shadow frame carton comprising:

(a) a rectangular window panel having a first window hinge edge and a second window hinge edge defining a corner of the window panel, and including an edge defining a window portion formed within the perimeter of the window panel, (b) a first four-sided shadow frame panel, hinged to the first window hinge edge, having a first rim edge opposite the first window hinge edge, (c) a second four-sided shadow frame panel, hinged to the second window hinge edge, having a second rim edge opposite the second window hinge edge, (d) a first side panel hinged to the first shadow frame panel along the first rim edge, (e) a second side panel hinged to the second shadow frame panel along the second rim edge, (f) a third side panel, (g) a fourth side panel, (h) a back panel, and (i) means for coupling the side panels and the back panel.

12. The carton blank in claim 11, wherein the window panel further includes a second window hinge edge and a third window hinge edge, the second and third window hinges forming a corner of the window panel, and including (a) a third rectangular shadow frame panel, hinged to the third window hinge edge, having a third rim edge parallel with and opposite the third window hinge edge, and (b) the third side panel hinged to the third shadow frame panel along the third rim edge.

13. The carton blank in claim 12, wherein the window panel further includes a fourth window hinge edge, the first and fourth window hinge edges forming a corner of the window panel, the third and fourth window hinge edges forming a corner of the window panel, and including (a) a fourth rectangular shadow frame panel, hinged to the fourth window hinge edge, having a fourth rim edge parallel with and opposite the fourth window hinge edge, and (b) the fourth side panel hinged to the fourth shadow frame panel along the fourth rim edge.

14. The carton blank in claim 11, wherein the means for coupling the back panel to the side panels includes a hinge between one of the side panels and the back panel, the hinge being parallel with, opposite and offset from the window panel edge.

15. The carton blank in claim 11, wherein the first and second shadow frame panels have a common dimension in the direction perpendicular to the respective first and second window hinge edges.

16. The carton blank in claim 15, wherein the first side panel includes a first flap hinge edge perpendicular to the first window hinge edge and colinear with the corner defined by the first and second window hinge edges, and a first flap hinged to the first side panel along the first flap hinge edge.

17. The carton blank in claim 16, wherein the first flap includes a support edge parallel with and nearly colinear with the first rim hinge.

18. The carton blank in claim 16, wherein further includes a second flap hinge edge perpendicular to the first window hinge edge and colinear with the intersection of the first and fourth window hinge edges, and a second flap hinged to the first side panel along the second flap hinge edge.

19. The carton blank in claim 18, wherein the second flap includes a support edge parallel with and nearly colinear with the first rim hinge.

20. The carton blank in claim 18, wherein the third side panel includes a third flap hinge edge perpendicular to the third window hinge edge and colinear with the intersection of the second and third window hinge edges, and a third flap hinged to the third side panel along the third flap hinge edge.

21. The carton blank in claim 20, wherein the third flap includes a support edge parallel with and nearly colinear with the third rim hinge.

22. The carton blank in claim 20, wherein the third side panel includes a fourth flap hinge edge perpendicular to the third window hinge edge and colinear with the intersection of the third and fourth window hinge edges, and a fourth flap hinged to the third side panel along the fourth flap hinge edge.

23. The carton blank in claim 22, wherein the fourth flap includes a support edge parallel with and nearly colinear with the third rim hinge.

24. A one piece planar carton blank for producing a shadow frame carton comprising:

(a) a rectangular window panel having in succession a first, a second, a third, and a fourth window hinge edge, and between successive hinge edges a first, a second, a third, and a fourth corner being formed, and including an edge defining window portion (b) within the perimeter of the window panel, a first, a second, a third, and a fourth rectangular shadow frame panel, each hinged respectively to the respective window hinge edge, each having a respective rim edge parallel with and opposite the respective window hinge edge, (c) a first side panel hinged to the first shadow frame panel along the first rim edge, including a first flap hinge edge perpendicular to the first window hinge edge and colinear with the first corner, and a second flap hinge edge perpendicular to the first window hinge edge and colinear with the fourth corner, (d) a first flap hinged to the first side panel along the first flap hinge edge, (e) a second flap hinged to the first side panel along the second flap hinge edge, (f) a second side panel hinged to the second shadow frame panel along the second rim edge, (g) a third side panel hinged to the third shadow frame panel along the third rim edge, including a third flap hinge edge perpendicular to the third window hinge edge and colinear with the second corner, and a fourth flap hinge edge perpendicular to the third window hinge edge and colinear with the third corner, (h) a third flap hinged to the third side panel along the third flap hinge edge, (i) a fourth flap hinged to the third side panel along the fourth flap hinge edge, (i) a back panel, and (k) means for coupling the side panels and the back panel.

* * * * *